US011674766B2

(12) United States Patent
Atias

(10) Patent No.: US 11,674,766 B2
(45) Date of Patent: Jun. 13, 2023

(54) AMMUNITION STORAGE AND FEEDING SYSTEM

(71) Applicants: Eliran Atias, Hazeva (IL); Amos Mont, Hazeva (IL); Nissim Majer, Tel Aviv-Jaffa (IL)

(72) Inventor: Eliran Atias, Hazeva (IL)

(73) Assignees: Eliran Atias, Hazeva (IL); Amos Mont, Hazeva (IL); Nissum Majer, Tel Aviv-Jaffa (IL)

( * ) Notice: Subject to any disclaimer, the term of this patent is extended or adjusted under 35 U.S.C. 154(b) by 0 days.

(21) Appl. No.: 17/068,271

(22) Filed: Oct. 12, 2020

(65) Prior Publication Data

US 2021/0222977 A1 Jul. 22, 2021

Related U.S. Application Data

(63) Continuation-in-part of application No. PCT/IL2019/050410, filed on Apr. 11, 2019.

(30) Foreign Application Priority Data

Apr. 12, 2018 (IL) ..... 258680

(51) Int. Cl.
*F41A 9/86* (2006.01)
*F41A 9/34* (2006.01)
*F41A 9/76* (2006.01)

(52) U.S. Cl.
CPC ..... *F41A 9/86* (2013.01); *F41A 9/34* (2013.01); *F41A 9/76* (2013.01)

(58) Field of Classification Search
CPC ..... F41A 9/86; F41A 9/34; F41A 9/76; F41A 9/29; F41A 9/30; F41A 9/31; F41A 9/32;
(Continued)

(56) References Cited

U.S. PATENT DOCUMENTS 1,192,723 A * 7/1916 Zumwalt ..... F41A 9/83 42/87
2,390,401 A * 12/1945 Trotter ..... F41A 9/30 89/33.5

(Continued)

FOREIGN PATENT DOCUMENTS

DE 0279048 A1 * 10/1987
DE 3812696 A1 * 4/1988

(Continued)

OTHER PUBLICATIONS

International Search Report for PCT/IL2019/050410; dated Jun. 25, 2019 (4 pages).

(Continued)

*Primary Examiner* — John Cooper
(74) *Attorney, Agent, or Firm* — Roach Brown McCarthy & Gruber, P.C.; Kevin D. McCarthy

(57) ABSTRACT

Ammunition storage and feeding system for light weapons that facilitates a continuous loading of the weapon, thereby relieving the user from multiple magazine replacements, and reducing potential weapon stoppages, thus providing more reliable and significantly uninterruptable use of the weapon with respect to operating the weapon with conventional magazines. According to an embodiment of the invention, the system is configured to automatically receive interlinked cartridges from a carrying device (e.g., a backpack or other convenient device harnessed to the user's body) through a flexible or semi-flexible leading means, to successively extract the cartridges from the linking arrangement and to successively feed each extracted cartridge into a dedicated magazine in a First In First Out (FIFO) manner.

10 Claims, 23 Drawing Sheets

(58) Field of Classification Search
CPC ..... F41A 9/33; F41A 9/35; F41A 9/37; F41A 9/36; F41A 9/375; F41A 9/38
USPC ..... 89/33.14, 33.2, 33.25, 33.4, 33.5, 34, 89/35.01, 35.02
See application file for complete search history.

(56) References Cited

U.S. PATENT DOCUMENTS 2,789,474 A * 4/1957 Burns ..... F41A 9/31 89/33.25
2,951,422 A * 9/1960 Bobkowski ..... F41A 9/04 89/33.14
3,412,681 A * 11/1968 Schirneker ..... F42B 5/035 89/14.05
3,747,469 A * 7/1973 Ashley ..... B65G 47/681 89/33.14
3,762,268 A * 10/1973 Gaye ..... F41A 9/80 89/34
3,766,823 A * 10/1973 Folsom ..... F41A 9/77 89/33.02
3,974,738 A * 8/1976 Meyer ..... F41A 9/34 89/34
4,831,914 A * 5/1989 Dardick ..... F41A 9/46 89/33.02
5,614,689 A * 3/1997 Gyre ..... F41A 9/54 89/33.17
5,782,157 A * 7/1998 Ellington ..... F41A 9/79 89/33.16
8,607,683 B1 * 12/2013 Burgermeister ..... F41A 9/31 89/34
2004/0025393 A1 * 2/2004 Reynolds ..... F41A 9/19 42/17
2015/0233658 A1 * 8/2015 Lescure ..... F41A 9/57 89/33.2
2016/0102931 A1 4/2016 Roberts et al.

FOREIGN PATENT DOCUMENTS

DE 19501706 A1 * 7/1995 ..... F41A 9/04
DE 102005003751 B3 * 7/2006 ..... F41A 15/04
GB 507739 6/1939
WO 0071961 A1 11/2000
WO 2019198085 A1 10/2019

OTHER PUBLICATIONS

Written Opinion of the International Searching Authority for PCT/IL2019/050410; dated Jun. 25, 2019 (6 pages).

* cited by examiner

AMMUNITION STORAGE AND FEEDING SYSTEM

FIELD OF THE INVENTION

The present invention relates to the field of ammunition. More particularly, the invention relates to ammunition storage and feeding system for a light weapon that facilitates a continuous loading of the weapon.

BACKGROUND OF THE INVENTION

Since the invention of the cartridge magazine, people tried to increase the amount of cartridges in each magazine while maintaining the relative ease of carrying and handling of a firearm in combat. Longer magazines may contain more cartridges but become significantly long and heavy, which make them difficult to operate and heavy to carry, due to the fact that the pouches of the magazines are located in the front of the modern assault vest. Smaller magazines will be easier to operate but will result in more frequent magazine switch, which consumes expensive time during combat and puts the soldier at greater risk.

Machine guns have a belt of linked cartridges and feeding mechanism that can separate the cartridges while feeding, such belt can be carried in drums, assault boxes and backpacks. But in assault rifle the feeding mechanism is designed for magazines, which require different feeding method.

For example, the Ultra-Compact AR-15 "Ribbon Spring" Concept Magazine, propose "U" shape magazines that contain double quantity of cartridges than regular magazine, but this magazine causes another crucial problem. Due to the laws of mechanics, as a mass (the magazine, in our case) located further from a pivot point (the soldier's shoulder) it applies more torque, so the carrier will have to apply more force to stabilize it. Therefore, heavier magazines will eventually result in a shorter operation time until exhaustion of the soldier and cumbersome maneuver with the weapon, which unfortunately may lead to slower response during combat.

It is therefore an object of the present invention to overcome the drawbacks of the existing solution and form a comfortable method and apparatus for storing, operating and carrying large amount of cartridges without the need of frequent switching and without the inconvenience of having heavy cargo in the front of the body, and without inventing a new type of assault rifle.

It is another object of the present invention to provide a system that enables the user to perform agile maneuver with the weapon and faster response during combat.

It is yet another object of the present invention, to provide a system that can be applied as an ad-on device to existing weapons (e.g., M-16, M4, AR-15 and the like) without the need to carry out any alterations in their structure.

Other objects and advantages of the invention will become apparent as the description proceeds.

SUMMARY OF THE INVENTION

The present invention relates to ammunition storage and feeding system for light weapons, comprising: a) a plurality of inter-linked cartridges linked by a linking arrangement, b) one or more extraction and feeding means configured to pull said plurality of inter-linked cartridges from a carrying device through a leading arrangement, wherein said one or more extraction and feeding means is configured to successively extract each individual cartridge of said plurality of inter-linked cartridges from said linking arrangement, and to successively feed each extracted cartridge to a dedicated magazine, from which the extracted cartridges are loaded to the weapon in a continuous and uninterrupted First In First Out manner (FIFO) manner.

In one aspect the invention relates to a tandem ammunition storage and feeding system, comprising: a) a plurality of serially-linked cartridges positioned one behind the other and pointing to the same direction, wherein said plurality of serially-linked cartridges are linked by a linking arrangement to form a serial ammunition belt, b) a feeding mechanism comprising a curved magazine and a cartridge receiving element that is adapted to receive the serial ammunition belt, and c) a lead tube adapted to connect said serial ammunition belt to said feeding mechanism.

According to an embodiment of the present invention, the linking arrangement comprises links that retain a single cartridge and are articulated with the cartridge ahead of it in said belt.

According to an embodiment of the present invention, the links are disintegrating or non-disintegrating.

According to an embodiment of the present invention, the cartridges are encapsulated by a tight sleeve.

According to an embodiment of the present invention, the proposed system further comprises a carrying device adapted to store the serially-linked cartridges, wherein said carrying device comprises an opening through which the serially-linked cartridges are pulled out.

According to an embodiment of the present invention, the magazine is adapted to be inserted into a corresponding magazine housing of a light weapon.

According to an embodiment of the present invention, the magazine functions as a conveyor by moving cartridges received at an inlet of said magazine into a position where they are loaded into a barrel chamber of the firearm by the action of said firearm.

According to an embodiment of the present invention, the proposed system further comprises a user interface configured to provide indications to the user.

In another aspect the invention relates to parallel ammunition storage and feeding system, comprising:

- a plurality of parallelly-linked cartridges linked by a linking arrangements to form a chain;
- an extraction module configured to pull said chain and to successively extract said plurality of parallelly-linked cartridges from linking arrangement thereof;
- a feeding mechanism configured to receive extracted cartridges from said extraction module, and to feed each individual extracted cartridge into a dedicated magazine that is configured to operate in a continuous First-In-First-Out (FIFO) manner, in which the dedicated magazine receives the cartridges (e.g., from the feeding mechanism) via a first opening and outputs the cartridges via a second opening through which the cartridges are loaded to a corresponding barrel of a weapon; and
- a lead duct adapted to connect said chain of parallelly-linked cartridges to said extraction module.

According to an embodiment of the present invention, the lead duct is semi-flexible.

According to an embodiment of the present invention, each of the linking arrangements comprises shell sections in which the parallelly-linked cartridges are housed, where the extraction module extracts said parallelly-linked cartridges by forcing said shell sections to separate.

According to an embodiment of the present invention, the dedicated magazine comprises a spring-loaded stopper, for regulating the feeding of said dedicated magazine by the feeding mechanism.

According to an embodiment of the present invention, the proposed system further comprises feedback means for providing operational and fault indications.

According to an embodiment of the present invention, the feedback means are selected from the group consisting of: optical sensors, pressure sensor, or any combination thereof.

According to an embodiment of the present invention, the Indications are selected from the group consisting of: visual indications, audial indications, mechanical indications, or any combination thereof.

According to an embodiment of the present invention, the proposed system further comprises a control means for receiving indications from the feedback means and to respond accordingly.

According to an embodiment of the present invention, the response is selected from the group consisting of: operation of the extraction module, operation of the feeding mechanism, initiation user operational and fault indications, or any combination thereof.

According to an embodiment of the present invention, each of the extraction module and the feeding mechanism comprises a rotation motor.

According to an embodiment of the present invention, the extraction module and the feeding mechanism are driven by a single motor.

DETAILED DESCRIPTION OF THE INVENTION

Figure 1A:
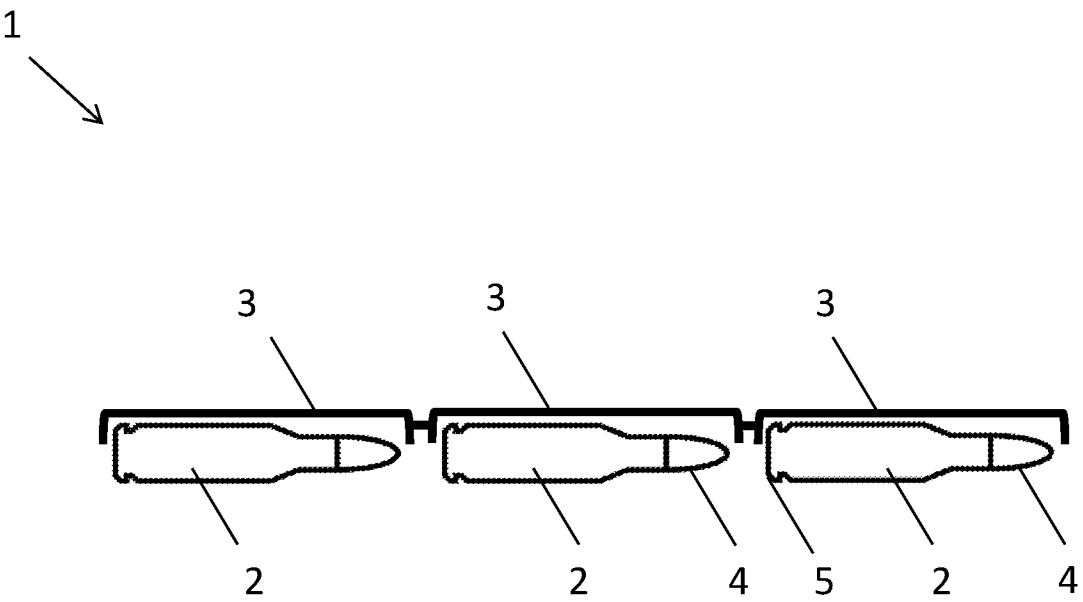
FIG. 1A schematically illustrates serially-linked cartridges that form a serial ammunition belt, according to an embodiment of the invention.

The present invention relates to ammunition storage and feeding system for light weapons that facilitates a continuous loading of the weapon, thereby relieving the user from multiple magazine replacements, and reducing potential weapon stoppages (e.g., due to incomplete insertion of a new magazine, defective magazine, etc.), thus providing more reliable and significantly uninterruptable use of the weapon with respect to operating the weapon with conventional magazines.

The proposed system is configured to automatically receive interlinked cartridges (i.e., by a disposable linking arrangement) from a carrying device (e.g., a backpack or other convenient device harnessed to the user's body) through a flexible or semi-flexible leading means, to successively extract the cartridges from the linking arrangement (e.g., by suitable extraction means) and to successively feed each extracted cartridge into a dedicated magazine in a First In First Out (FIFO) manner.

Throughout this description, the term "serial ammunition belt" is used to indicate a device that is adapted to retain and feed cartridges into a firearm in a serial manner, wherein the device comprises a plurality of serially-linked cartridges pointing to the same direction. In other words, the cartridges are linked one before the other in a manner that the front section of one cartridge (i.e., the tip of the cartridge's projectile) is located behind the rear section of a cartridge located ahead of it in the belt (e.g., projectile's tip of one cartridge faces the primer of a cartridge located ahead of it in the belt). This term does not imply any particular shape, construction material, geometry, or a method of a linking arrangement and the invention applies to all suitable linking arrangements that enable to form a serial ammunition belt.

In one aspect, the present invention provides a tandem ammunition storage and feeding system that involves a revolutionary method of linking cartridges serially, instead of the well-known parallel form. The system comprises a plurality of serially-linked cartridges pointing to the same direction (refers herein to a "serial ammunition belt" or shortly a "belt") and a feeding mechanism that includes a dedicated magazine for successively loading the dedicated magazine with the cartridges. Depending on the configuration of the feeding mechanism, the cartridges can be loaded to the dedicated magazine after or before each cartridge has been stripped from the belt. The system of the present invention provides a combination of an ammunition belt and a magazine, working together to automatically and continuously loading a weapon, such as a rifle or other type of light weapon. According to an embodiment of the invention, the serial ammunition belt can be stored in a carrying device and the feeding mechanism can be coupled to the weapon by using the dedicated magazine. According to an embodiment of the invention, the system may comprise a flexible (or at least semi-flexible) lead tube that is used to connect the belt to the feeding mechanism and to route the linked cartridges into the feeding mechanism, wherein the tube is adapted to receive the linked cartridges at one end and to serially extract them into the feeding mechanism via the other tube's end. That carrying device can be carried by a user in the most convenient way for him, either on his back (as a backpack) or tied to any other place or region of his body.

Reference will now be made to an embodiment of the present invention, examples of which are illustrated in the accompanying figures for purposes of illustration only. One skilled in the art will readily recognize from the following description that alternative embodiments of the structures and methods illustrated herein may be employed, mutatis mutandis, without departing from the principles of the claimed invention.

FIG. 1A schematically illustrates a serial ammunition belt 1, according to an embodiment of the present invention. Serial ammunition belt 1 comprises a plurality of serially-linked cartridges 2 and a linking arrangement 3. Each cartridge 2 usually comprises a bullet or a projectile located at its front end 4, and a primer located at its rear end 5. In belt 1, cartridges 2 are positioned one behind the other and are pointing in the same direction, thus the front end 4 of one cartridge is located behind the rear end 5 of the cartridge located ahead of it in belt 1.

The cartridges 2 can be serially linked in a variety of ways while employing different linking methods. For example, the linking arrangement may involve disintegrating or non-disintegrating links that retain a single cartridge and are articulated with the cartridge ahead of it in the belt. In such an arrangement, the links can be rigid, semi-rigid, or a combination of rigid and semi-rigid form. In another example, the linking arrangement can be in form of a flexible sleeve, thus the cartridges can be tightly placed in the sleeve and be separated from each other by a shrinking of the sleeve between each cartridge, i.e., resembling a "sausage links" form.

Figure 1B:
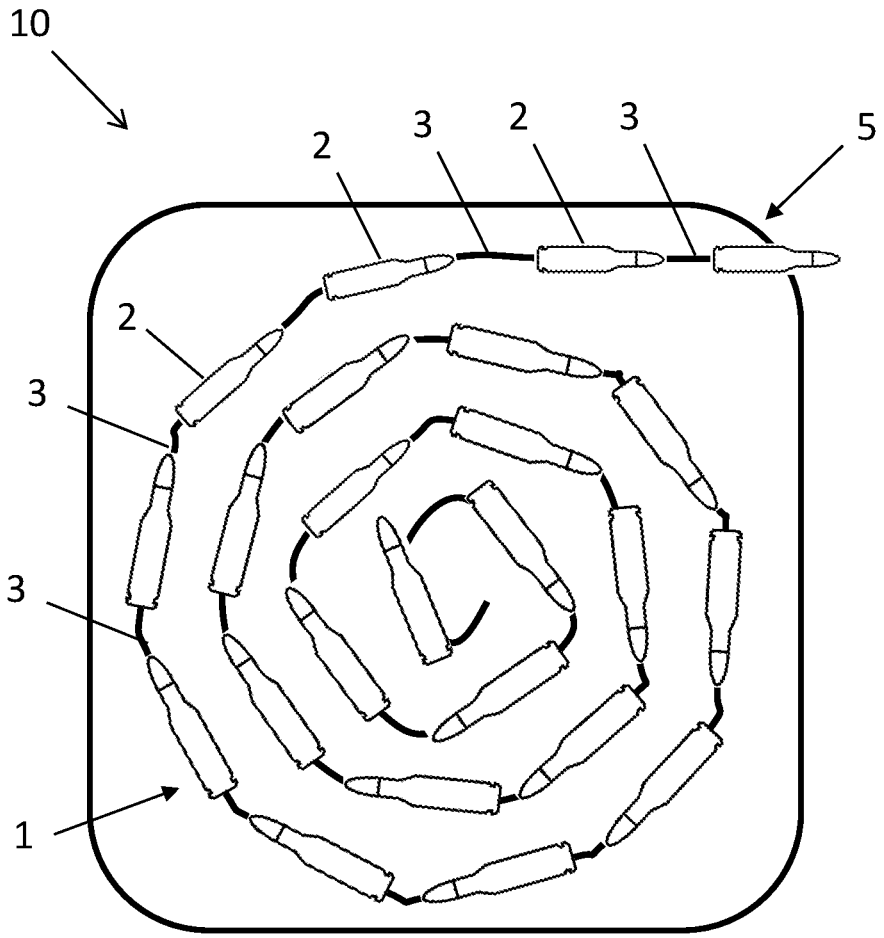
FIG. 1B schematically illustrates the serial ammunition belt of FIG. 1A stored within a carrying device in a spiral-like manner, according to an embodiment of the invention.

FIG. 1B schematically illustrates a cross-sectional view of serial ammunition belt 1 stored in a carrying device 10, according to an embodiment of the present invention. In this embodiment, the cartridges are arranged in a spiral manner and the edge of belt 1 (i.e., the first cartridge 2) can be pulled out through an opening 5 in carrying device 10.

Figure 2:
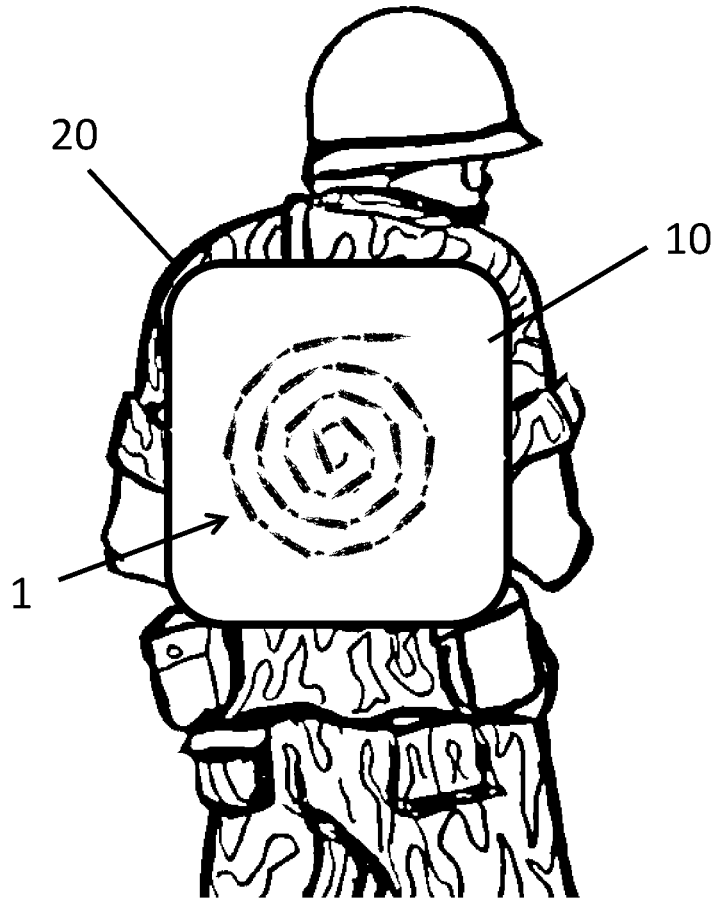
FIG. 2 schematically illustrates a user wearing a carrying device in the form of a backpack that contains the serial ammunition belt, according to an embodiment of the invention.

FIG. 2 shows a carrying device 10 that can be used in conjunction with the invention. The device illustrated in this figure is particularly convenient because it is designed like a backpack and it can be comfortably carried by a user 20.

Figure 3:
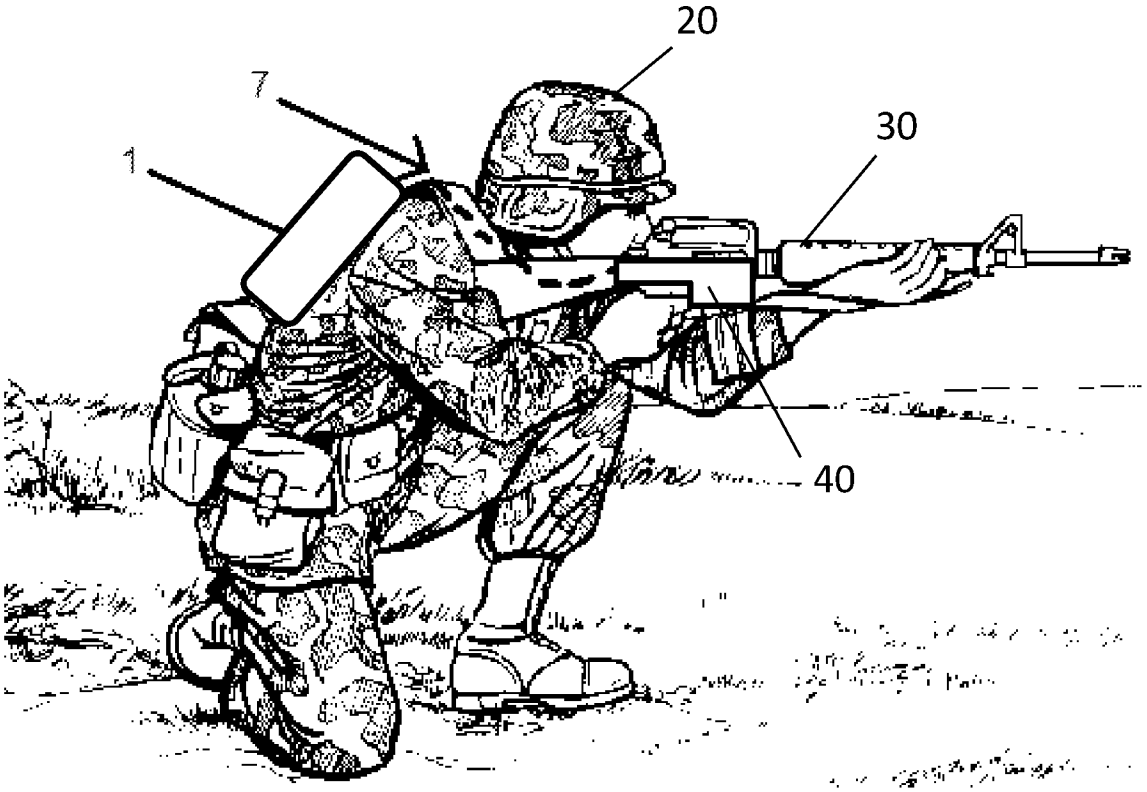
FIG. 3 schematically illustrates a semi-flexible lead tube that connects the serial ammunition belt to a feeding mechanism that is coupled to a rifle, according to an embodiment of the invention.
Figure 4B:
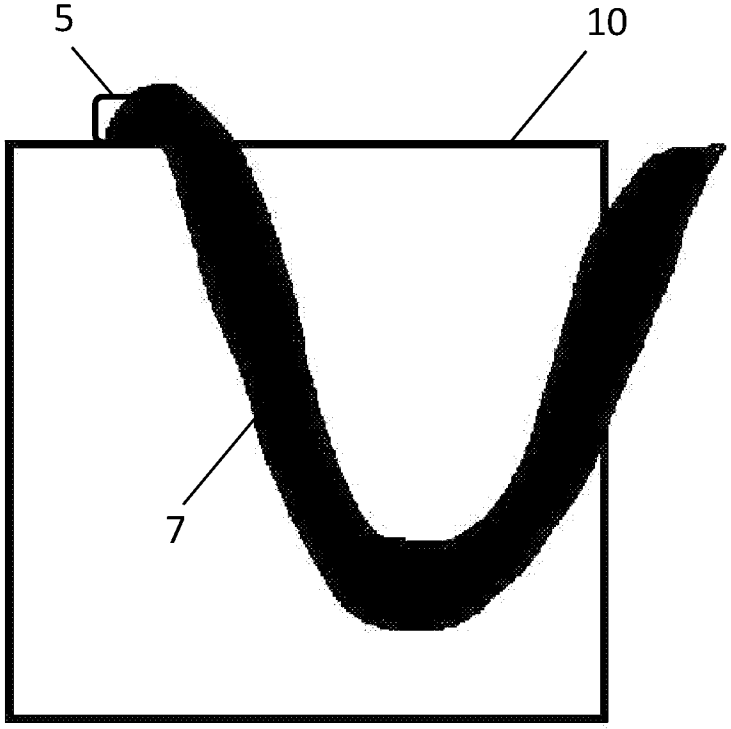
FIG. 4B schematically illustrates the semi-flexible lead tube coupled to the carrying device.
Figure 4A:
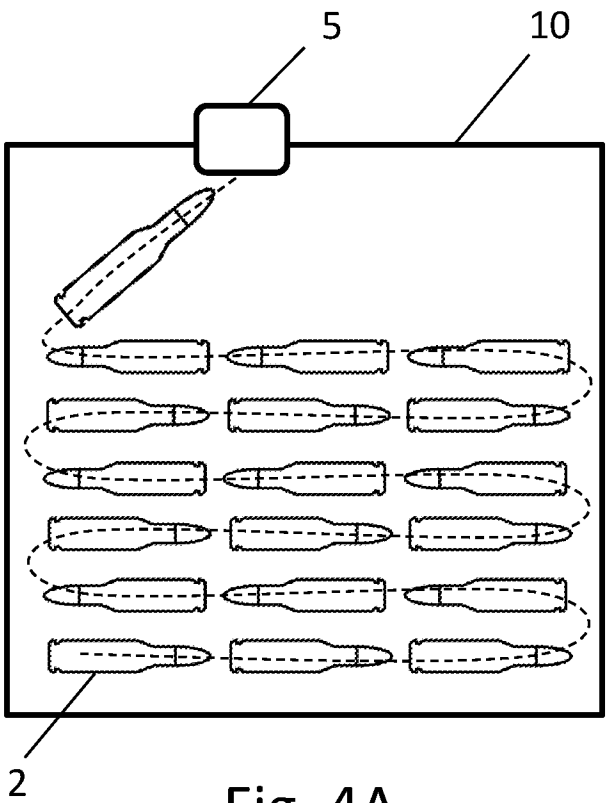
FIG. 4A schematically illustrates a cross-sectional view of a carrying device that shows the cartridges stored in a folded manner, according to an embodiment of the invention.

FIG. 3 schematically illustrates user 20 wearing device 10 on his back and aiming a rifle 30. A flexible/semi-flexible lead tube 7 (indicated by a dashed line), goes from device 10 (e.g., via opening 5 of device 10) along the shoulder of user 20 to a feeding mechanism 40 that is connected to rifle 30, according to an embodiment of the invention. FIG. 4A schematically illustrates a sectioned view of carrying device 10 and the serial ammunition belt 1 stored therein in a folded manner, and FIG. 4B schematically illustrates lead tube 7 coupled to carrying device 10.

Figure 5B:
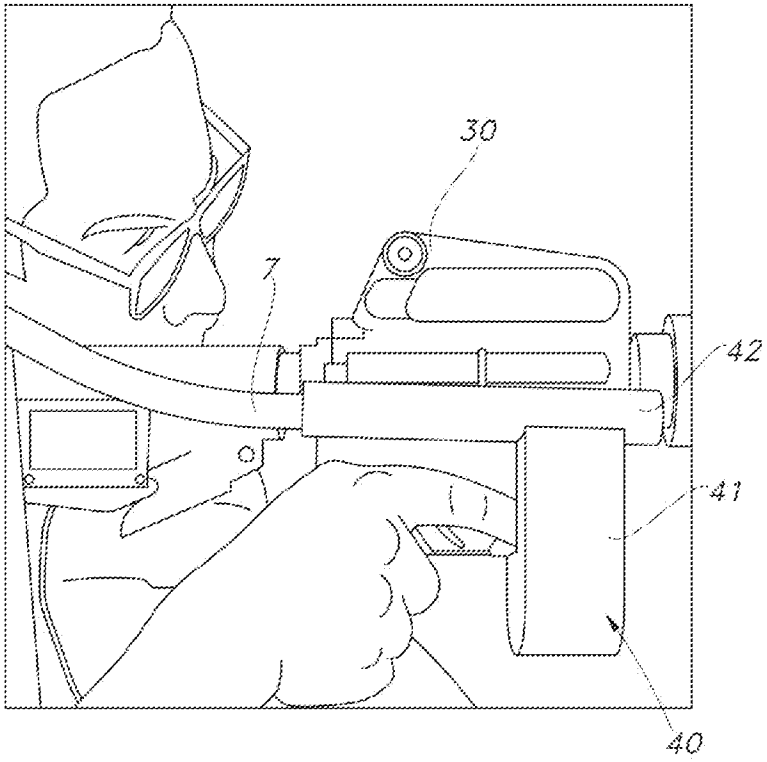
FIG. 5B schematically illustrates the position of the feeding mechanism of FIG. 5A after being connected to the rifle.
Figure 5A:
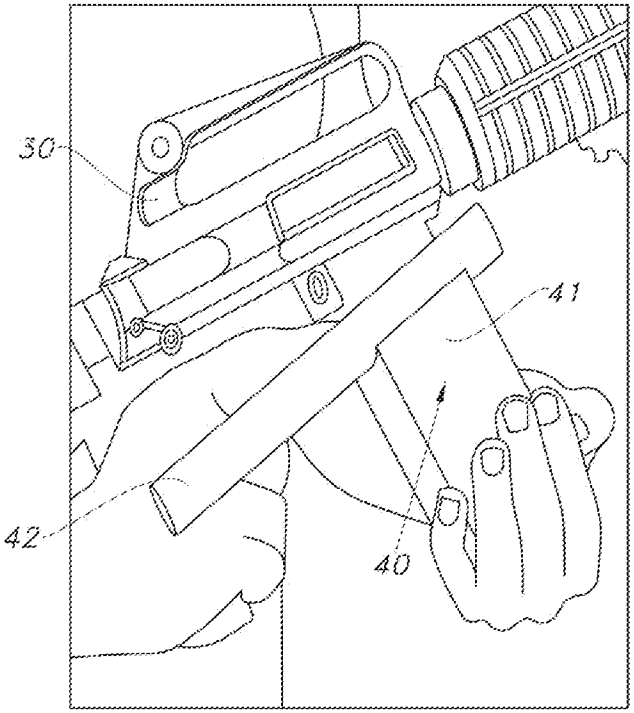
FIG. 5A schematically illustrates a detailed view of a feeding mechanism before the coupling with a rifle, according to an embodiment of the invention.

FIGS. 5A and 5B schematically illustrate a detailed view of feeding mechanism 40 connected to rifle 30, according to an embodiment of the invention. Feeding mechanism 40 comprises a curved magazine 41 (e.g. U-shaped magazine) and a cartridge receiving element 42 (e.g., in form of an elongated pipe). Magazine 41 is adapted to be inserted into a corresponding magazine housing of rifle 30. Magazine 41 functions as a conveyor by moving the cartridges 2 received at an inlet (indicated by numeral 17 in FIG. 6) of magazine 41 and stored within it into a position where they may be loaded into the barrel chamber of rifle 30 by the action of firearm 30. FIG. 5B schematically illustrates the distal end of lead tube 7 inserted into the cartridge receiving element 42 of feeding mechanism 40.

Figure 6:
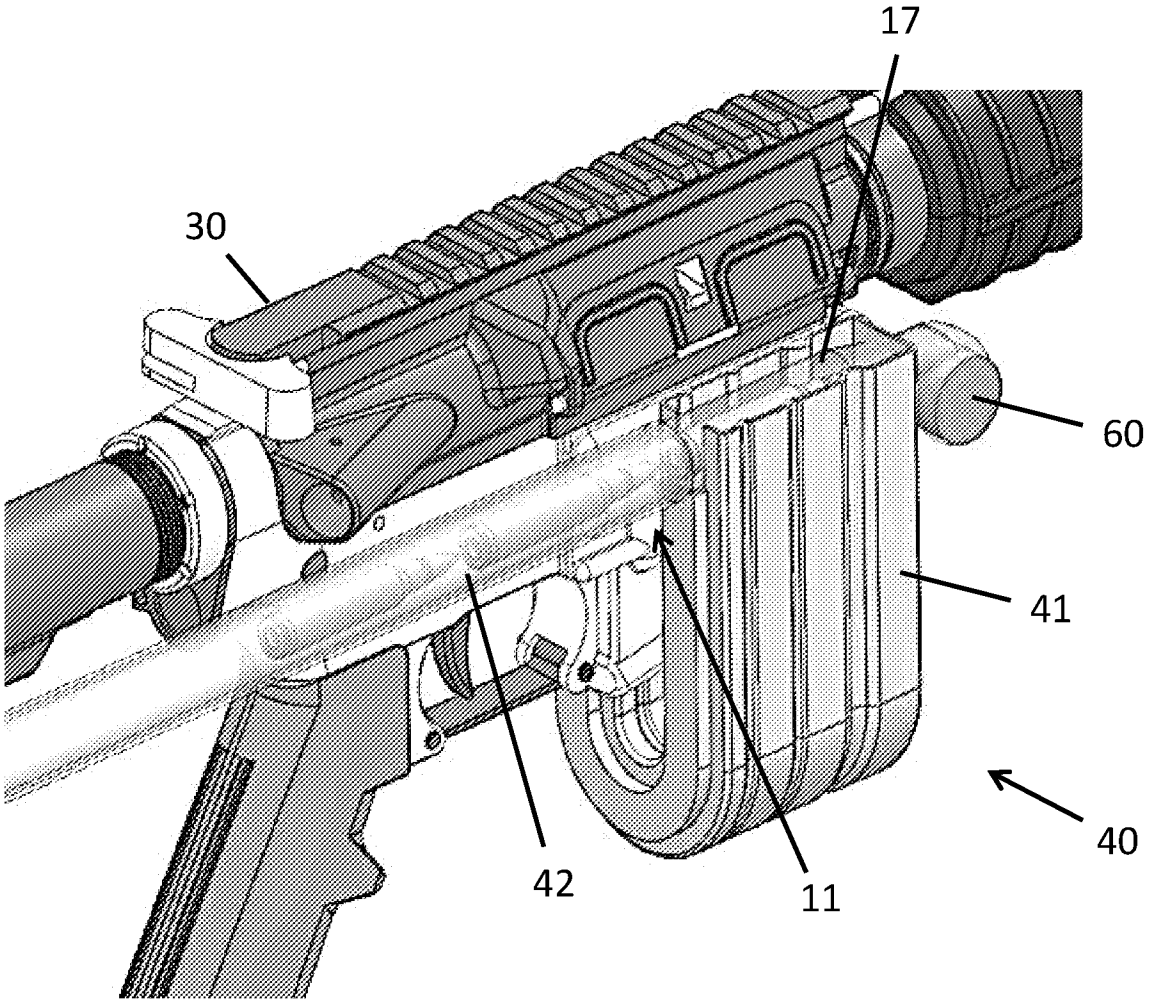
FIG. 6 schematically illustrates a more detailed view of the feeding mechanism while receiving and loading cartridges, according to an embodiment of the invention.

FIG. 6 schematically illustrates a more detailed view of feeding mechanism 40 while receiving cartridges 2 into the cartridge receiving element 42 from the distal end of lead tube 7, according to an embodiment of the invention. Feeding mechanism 40 may operate as follows: the serial ammunition belt 1 is pulled through cartridge receiving element 42 by a pulling mechanism 60 located adjacent to inlet 17 of magazine 41. In this embodiment, a cartridge extractor 11 is placed at the connection point between cartridge receiving element 42 and magazine 41 to strip the cartridges 2 from the serial ammunition belt 1. For example, in case cartridges 2 are linked by an element such as a tight sleeve, extractor 11 can be provided in form of a sharp element (e.g., as illustrated by sharp tool 13 in FIG. 7) that is adapted to tear the sleeve and accordingly to strip the cartridges out of the serial ammunition belt 1 while they are loaded into magazine 41 via inlet 17.

Figure 7:
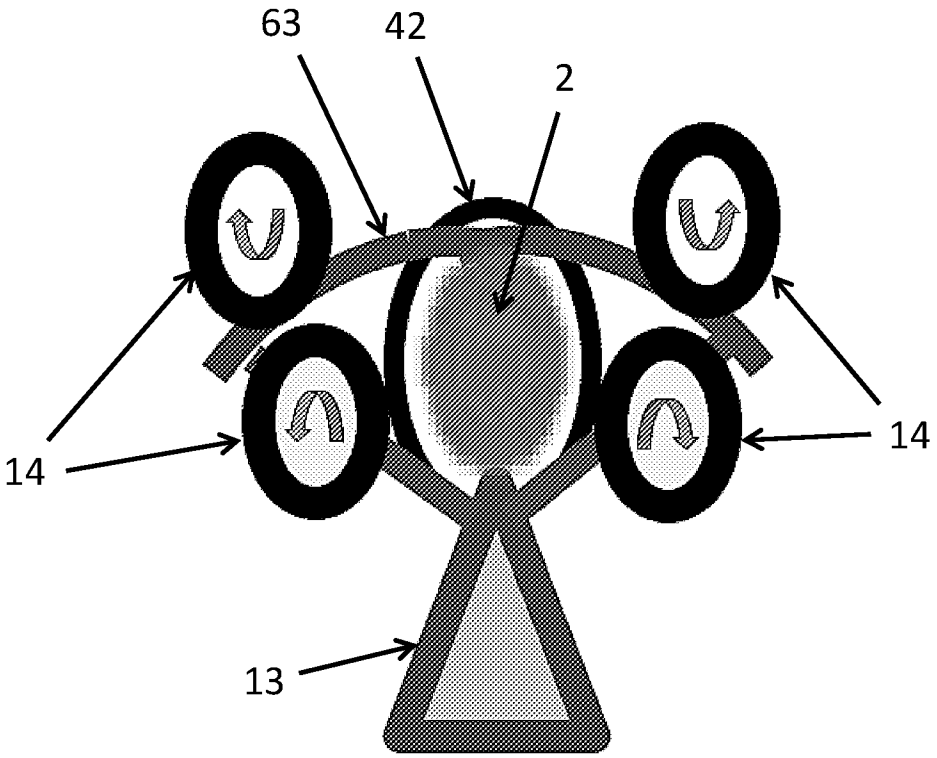
FIG. 7 schematically illustrates a cross-section view of a cartridge separator that strips cartridges from the serial ammunition belt (i.e., a pull-rip mechanism), according to an embodiment of the invention.

FIG. 7 schematically illustrates a cross-sectioned view of extractor 11, according to an embodiment of the invention. A sharp tool 13 is placed under the serial ammunition belt 1 (e.g., as demonstrated by a portion of a linking arrangement 3 in form of a sleeve) and splits the linking arrangement 3 while it is pulled toward magazine 41. In this example, a set of rollers 14 remove the split parts of linking arrangement 3 from feeding mechanism 40 to avoid jams, while pulling it. The cartridge 2 is then pulled out of the cartridge receiving element 42 into magazine 41 via inlet 17.

Figure 8:
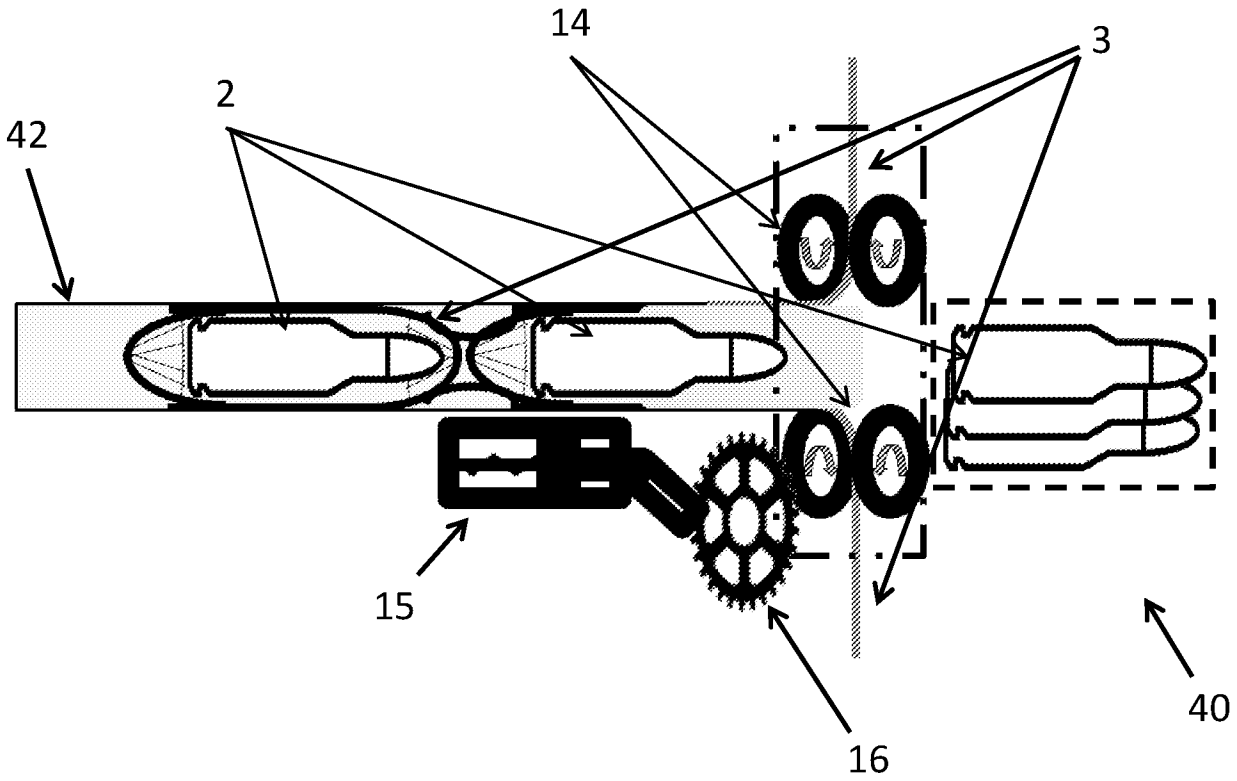
FIG. 8 schematically illustrates a cross-section view of a cartridge separator that strips cartridges from the serial ammunition belt, according to another embodiment of the invention.

FIG. 8 schematically illustrates a length sectioned view of extractor 11. According to an embodiment of the present invention, the rollers 14 may roll by receiving energy from an energy source 15 via a transmission 16, to pull and strip cartridges 2 from linking arrangement 3 and to remove the torn portion of linking arrangement 3 from which the cartridge 2 has been stripped. Different types of energy sources 15 may be used to power feeding mechanism 40, such as an electric motor, pneumatic arrangement, etc.

Figure 9:
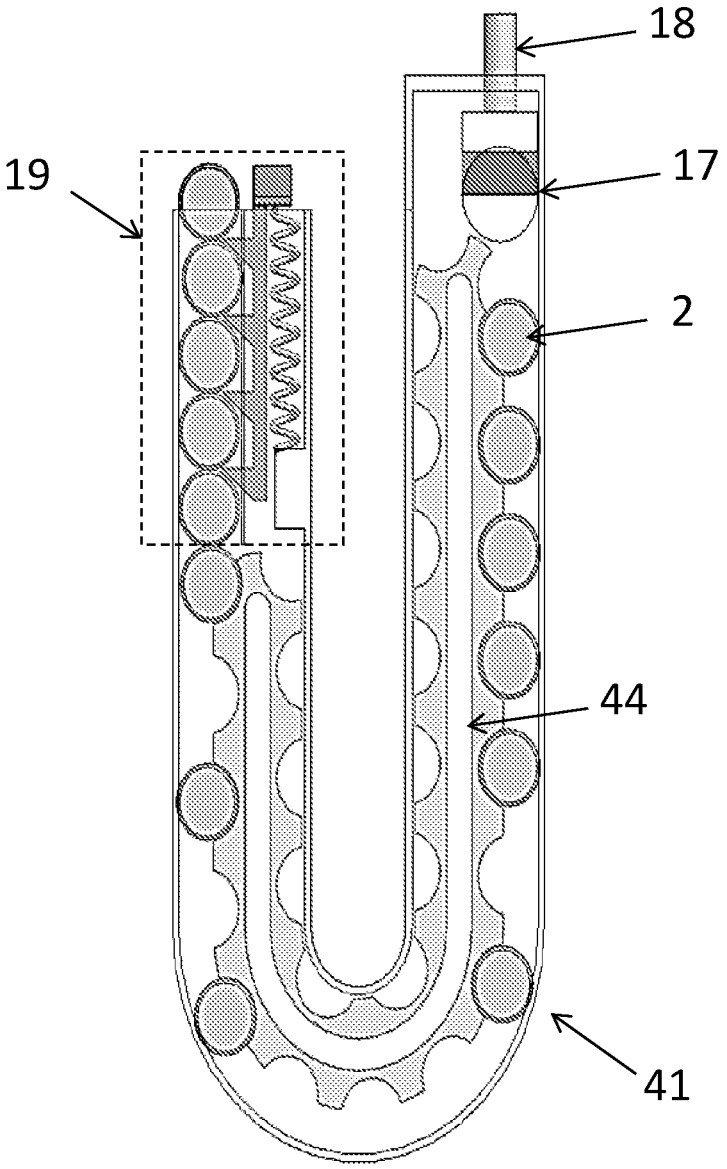
FIG. 9 schematically illustrates a cross-sectioned view of a curved magazine, according to an embodiment of the invention.

FIG. 9 schematically illustrates a sectioned view of the curved magazine 41, according to an embodiment of the invention. The cartridges 2 enter magazine 41 through inlet 17 and pushed down to a conveyor 44 by a piston 18. The conveyor 44 rotates constantly (e.g., clockwise) and delivers the cartridges 2 to a one-way lift 19 that lifts the received cartridges 2 toward the barrel chamber of firearm 30 (e.g., rifle's standby position).

Figure 10:
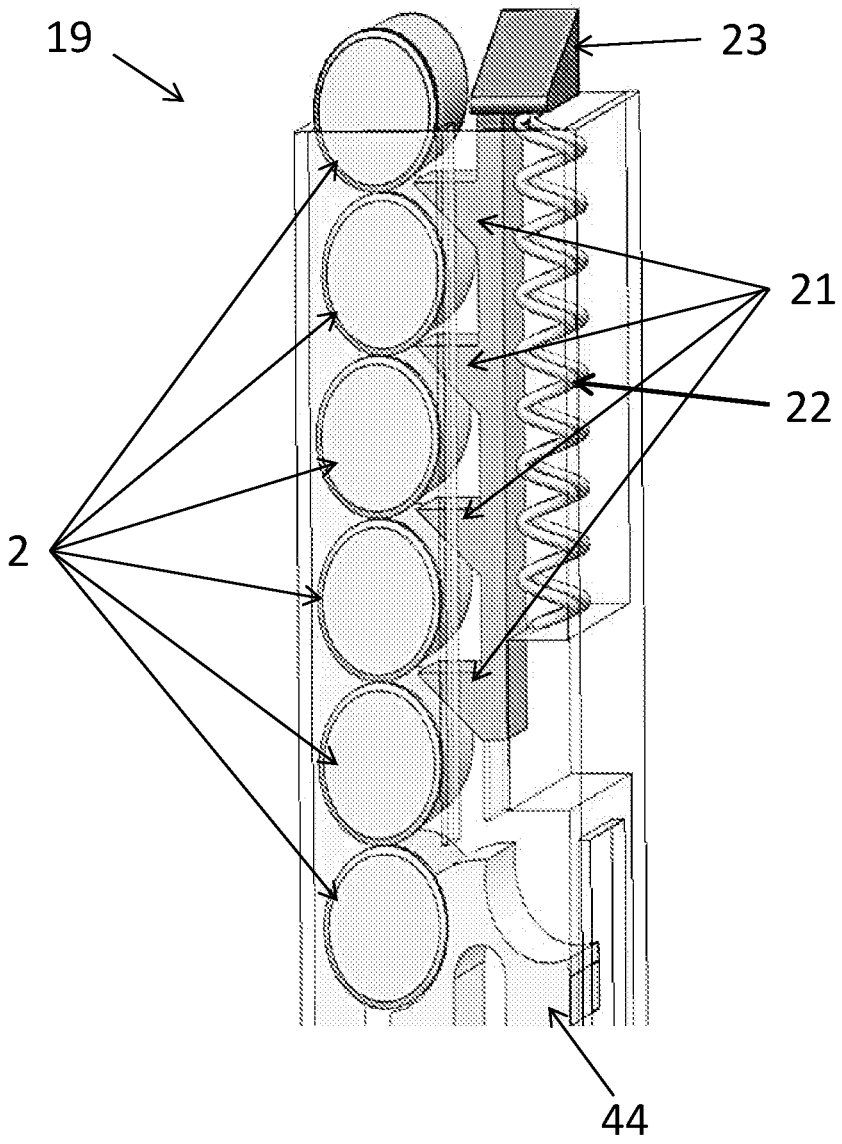
FIG. 10 schematically illustrates a detailed view of the rifle feeding section of the curved magazine of FIG. 9.

FIG. 10 schematically illustrates a detailed view of the one way lift 19, according to an embodiment of the invention. The cartridge 2 reaches the end of conveyor 44 and is pulled upward by element 21. When a bolt carrier (not shown) moves forward the bottom-right jag of the bolt sweeps the cartridge 2 and the bottom right jag of the bolt pushes element 23 down. When the bolt carrier moves backward a spring 22 pushes element 21 to bring a new cartridge up (in a standard magazine, the bottom jags sweep cartridges from the right and left sides of the magazine).

Figure 11:
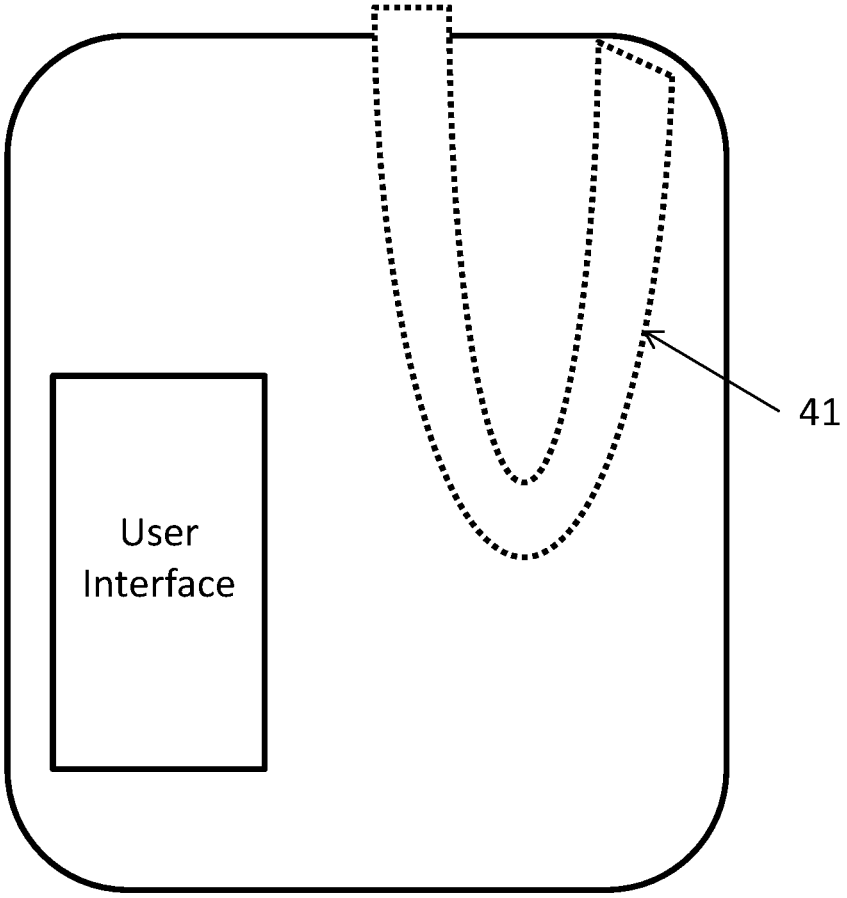
FIG. 11 schematically illustrates an embodiment of the invention, where the curved magazine constitutes a part of a larger smart apparatus.
Figure 12A:
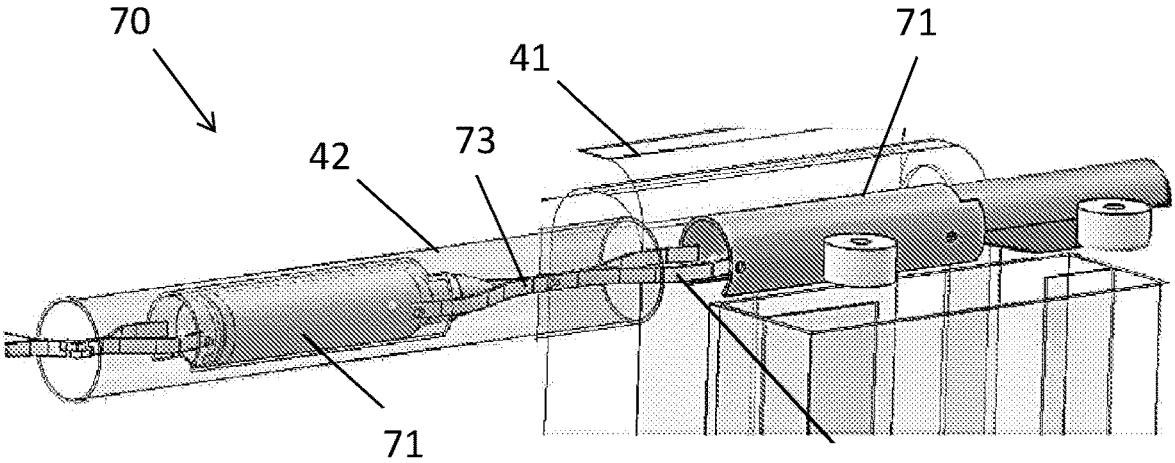
FIGS. 12A-12D schematically illustrate a method of linking cartridges, according to an embodiment of the invention. This method involves a semi-rigid "C" shaped links that houses the cartridge and a corresponding extracting mechanism.
Figure 12B:
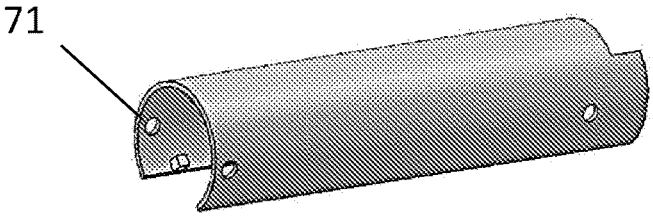
Figure 12C:
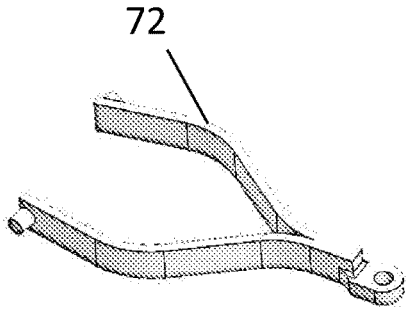
Figure 12D:
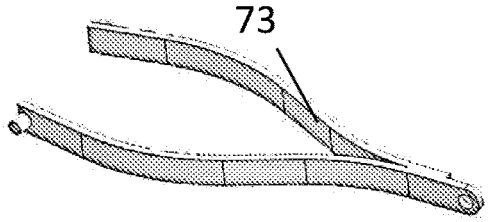
Figure 13A:
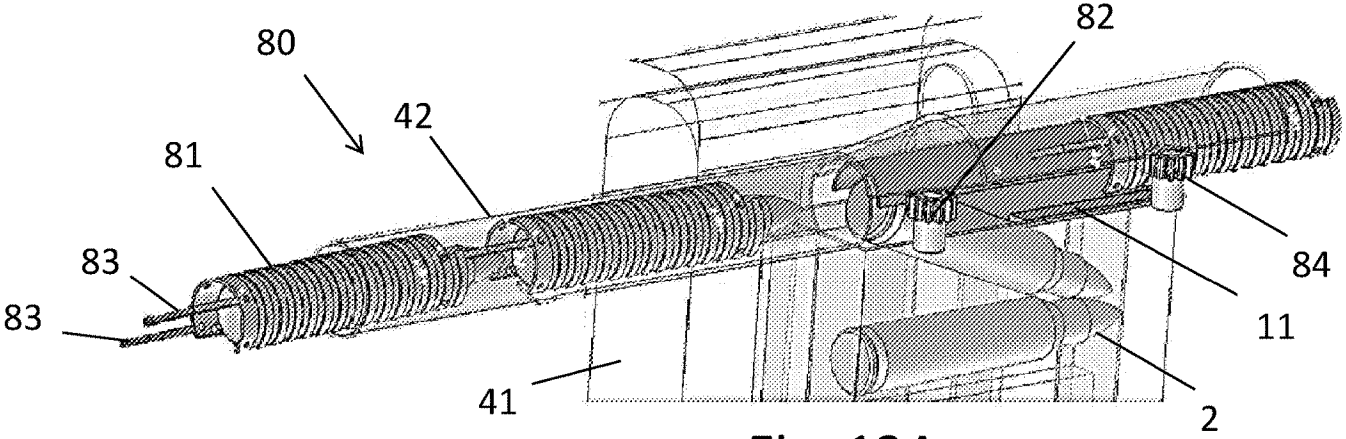
FIGS. 13A-13E schematically illustrate another method of linking cartridges, according to an embodiment of the invention.
Figure 13C:
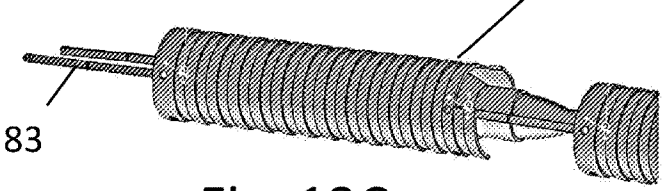
Figure 13E:
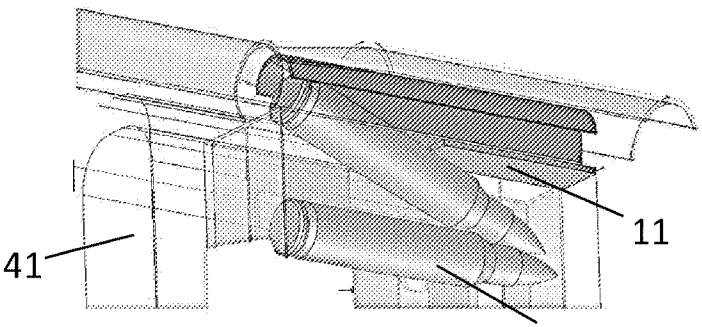
Figure 13B:
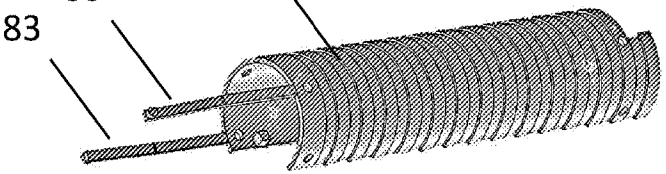
Figure 13D:
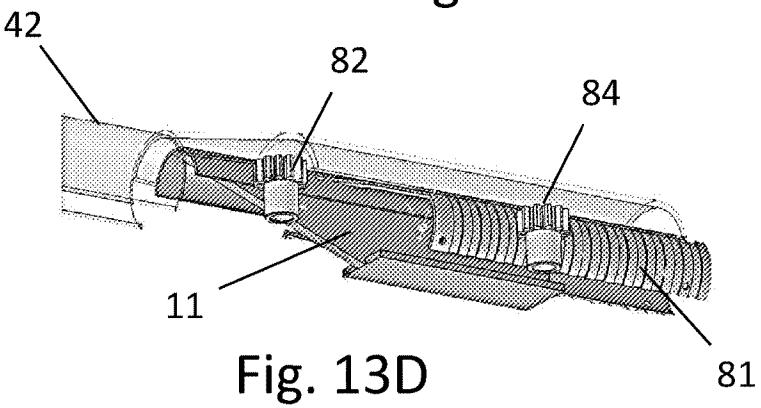

Referring now to FIG. 11, according to an embodiment of the invention, the mechanism of the curved magazine 41 is implemented within a magazine housing that comprises a user interface unit that may involve a display and/indication means adapted to provide the user with an indication such as the number of cartridges left in belt 1, system failures (e.g., by providing data relative to the reading of one or more sensors. The sensors can be installed in different locations of the system, such as within the magazine or other parts of the feeding mechanism, etc.), system power indication (e.g., a power level of built-in power source, such as the charge level of a system's battery), etc.

FIGS. 12A, 12B, 12C, and 12D schematically illustrate a linking arrangement 70, according to an embodiment of the invention. Linking arrangement 70 comprises a "C" shaped sliced tube 71, and a pair of "wishbone" shape connectors 72 and 73 (i.e., each of which has a forked end and a single end). Tube 71 is adapted to retain a single corresponding cartridge 2. Each tube 71 may comprise teeth on its inner rear part to force the retained cartridge 2 to move forward. The tubes 71 are configured to be connected in an articulated manner by the pair of "wishbone" shape connectors 72 and 73, while connectors 72 and 73 are configured to connect via their single end. Connectors 72 and 73 are designed to allow a 2-axis movement for maximal flexibility. For example, the connectors 72 and 73 may have two teeth in their forked end, which are adapted to be inserted to corresponding holes located in front and rear ends of tubes 71.

FIGS. 13A, 13B, 13C, 13D, and 13E schematically illustrate a linking arrangement 80, according to an embodiment of the invention. Linking arrangement 80 comprises a "C" shaped sliced tube 81 (generally similar to tube 71), but in contradiction to tube 71, tube 81 is jagged from outside. According to some embodiments, tube 81 is smooth from inside and jagged from outside. This arrangement allows smooth cartridge loading and unloading and enables the belt 1 to be pulled by a gear 82. Tubes 81 are adapted to be connected in an articulated manner. For example, each tube 81 may comprise two built-in flexible connectors 83 at its rear side, that connect to the front side of the next tube 81, thereby enabling a 2-axis movement and a simple cartridge unload process. The cartridge 2 pushes connectors 83 and retained them inside corresponding holes in tube 81. The moment tube 81 is emptied (i.e., cartridge 2 has been stripped) connectors 83 are separated from tube 81 and let the last tube 81 to be pulled out. To unload the cartridges 2 from tube 81, extractor 11 is provided in form of a wedge and is placed at the top of the magazine's 41 loading hatch (i.e., inlet 17) that forces the cartridge 2 out of the tube 81 and into the magazine 41. The emptied tubes 81 are pulled out by a second gear 84 that can be spaced apart from gear 82.

Figure 14:
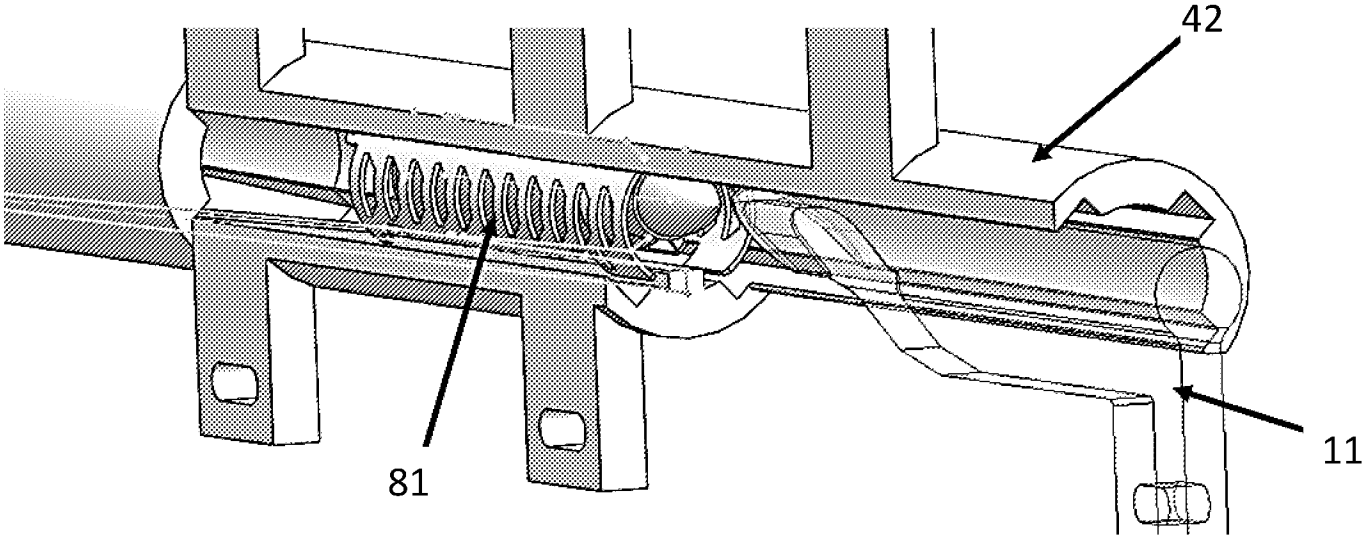
FIG. 14 schematically illustrates a partially cross-sectioned view of the cartridge receiving element, while the linking arrangement received within its interior, according to an embodiment of the invention.
Figure 15:
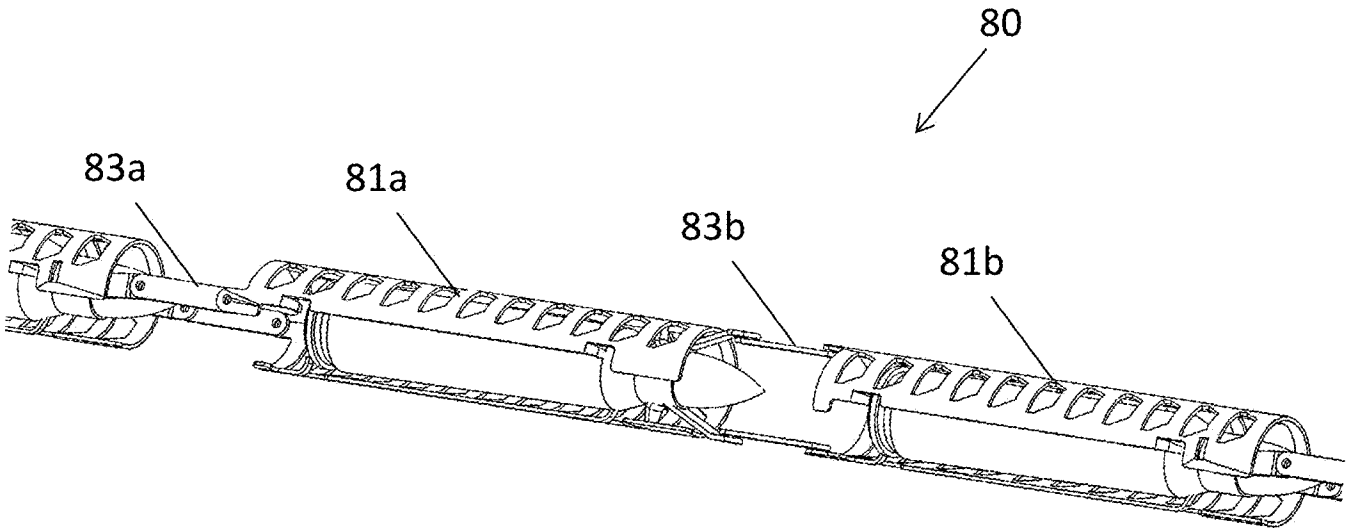
FIG. 15 schematically illustrates a linking arrangement, according to an embodiment of the invention.

FIG. 14 schematically illustrates a partially cross-sectioned view of the cartridge receiving element 42, while tube 81 of linking arrangement 80 is received within its interior. In this embodiment, cartridge receiving element 42 is provided in the form of a rigid pipe which interfaces with one end of the lead tube 7 (i.e., the outermost end where the cartridges 2 are being stripped from tube 81 of linking arrangement 80 by the cartridge extractor 11 and are being fed into the magazine 41). In this embodiment, tube 81 of linking arrangement 80 having a "C" shaped-like profile that is adapted to enable the elements of linking arrangement 80 as well as each cartridge 2 housed therein to be oriented and positioned properly with respect to the position of the cartridge extractor 11. Referring now to FIG. 15, according to an embodiment of the invention, linking arrangement 80 comprises pairs of following links 81*a* and 81*b*, wherein the connectors such as connectors 83*a* and 83*b* that links each following tubes are oriented alternately with respect to one another. Such alternate orientation may facilitate elements of linking arrangement 80 as well as each cartridge 2 to be oriented and positioned properly with respect to the position of the cartridge extractor 11.

In another aspect of the present invention, a parallel ammunition storage and feeding system is proposed, being adapted to receive parallelly-linked cartridges through a semi-flexible leading duct, where the received parallelly-linked cartridges are pulled through an extraction module that successively extracts each cartridge from the parallelly-linked cartridges. A feeding mechanism successively feeds the extracted cartridges into a dedicated magazine that has a first opening for successively receiving fed cartridges (e.g., a lateral intake aperture that can be used as a cartridge loading port of the magazine), and a second opening (e.g., a top exhaust aperture) through which cartridges are loaded to the weapon's barrel.

Figure 16A:
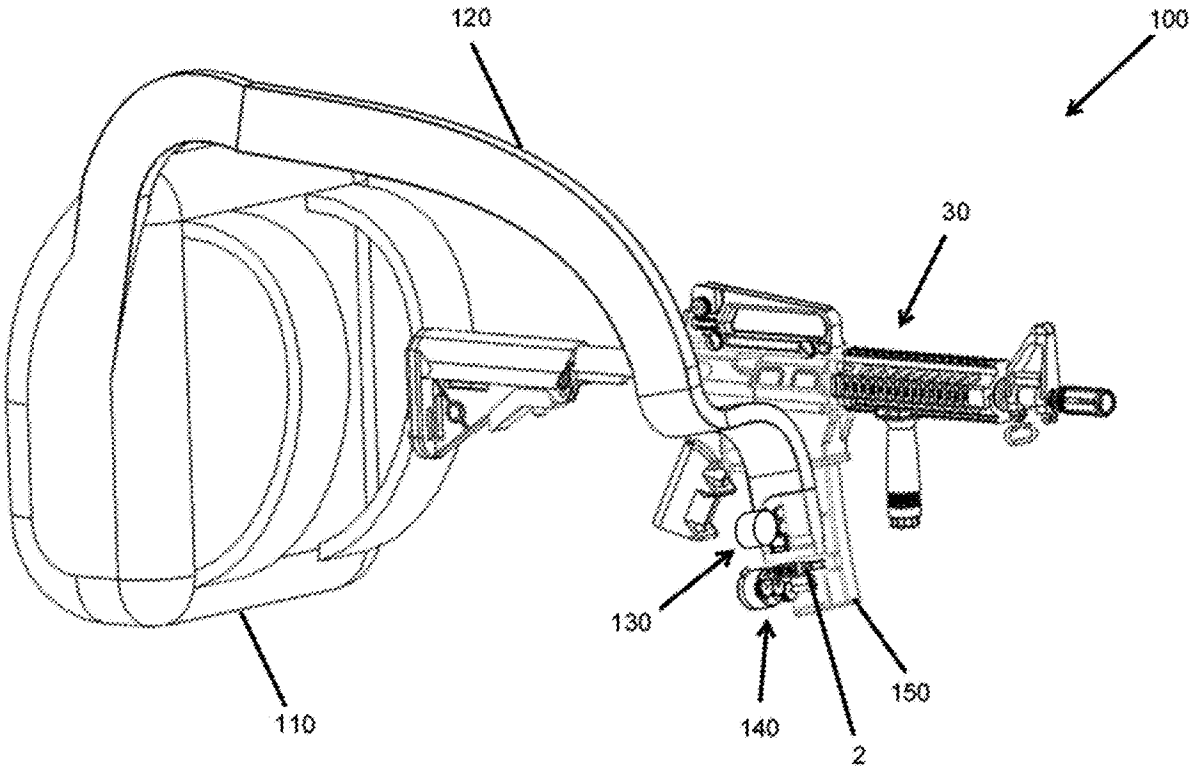
FIGS. 16A-16B schematically illustrate a perspective view of a rifle equipped with an ammunition storage and feeding system, according to an embodiment of the invention.
Figure 16B:
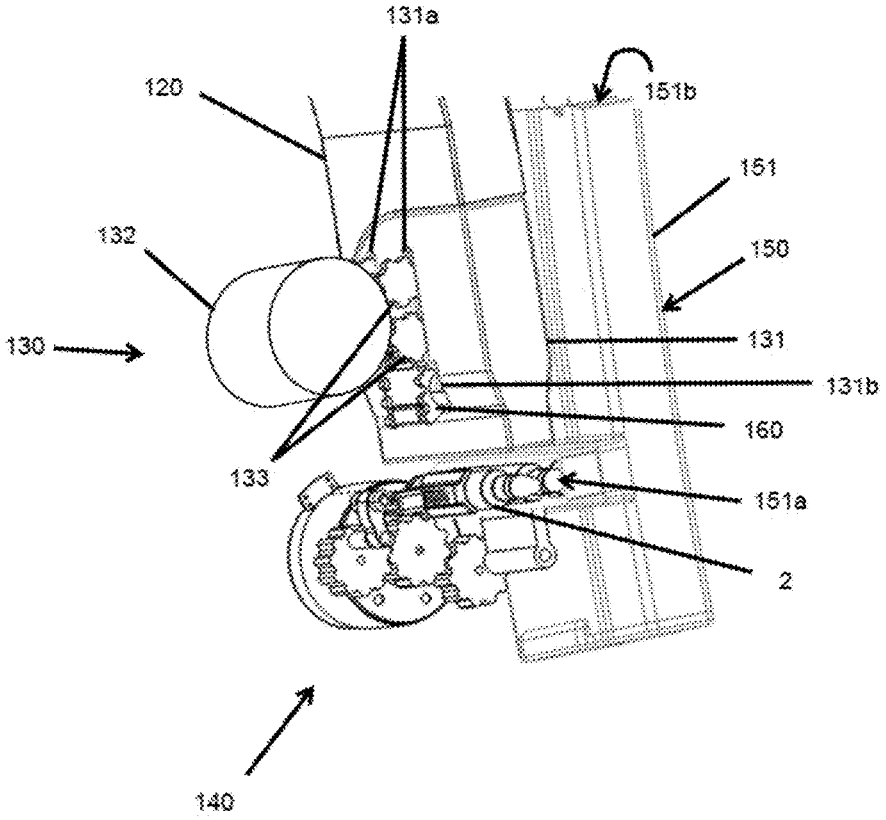
Figure 17A:
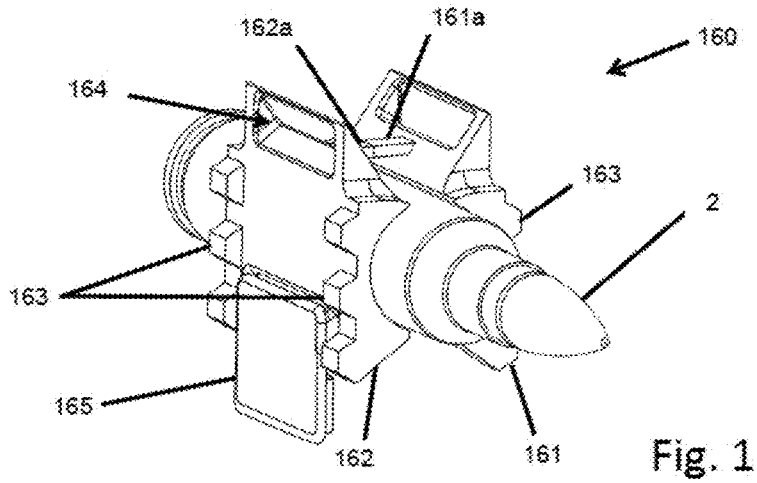
FIG. 17A schematically illustrates an exemplary configuration of a linking arrangement suitable for use by an ammunition storage and feeding system, according to an embodiment of the invention.
Figure 17B:
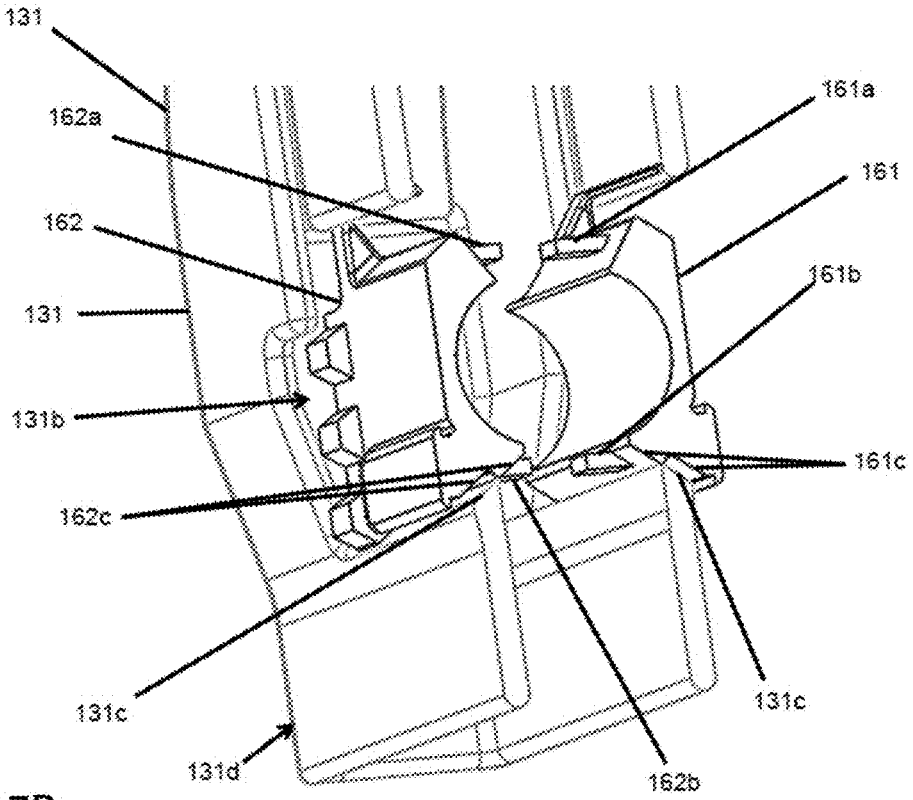
FIG. 17B schematically illustrates disintegration of a linking arrangement by extraction module 130, according to an embodiment of the invention.

FIGS. 16A-16B schematically illustrate a perspective view of rifle 30 equipped with a parallel ammunition storage and feeding system 100, according to an embodiment of the invention, in which system 100 is adapted to receive parallelly-linked cartridges 2 (i.e., each of which is housed within a linking arrangement such as illustrated in FIGS. 17A-17B) from a carrying device such as backpack 110 through a semi-flexible leading duct 120 and an extraction module 130 by a lateral feeding mechanism 140 (i.e., for the sake of illustrations extraction module 130 and feeding mechanism 140 are shown without the enclosures thereof), which feeds the extracted cartridges 2 (i.e., extracted from the linking arrangement thereof by extraction module 130) into a dedicated magazine 150 having a separate lateral intake aperture 151*a* (FIG. 16B) for receiving fed cartridges, and a second top exhaust aperture 151*b* (FIG. 16B) through which cartridges are loaded to the barrel of rifle 30.

Being semi-flexible, lead duct 120 enables effortless maneuvering with rifle 30 used in conjunction with system 100, as well as easy un-wearing of any component thereof (e.g., putting aside rifle 30, un-wearing backpack 110 or any other desirable action.

FIG. 16B further provides an enlarged illustration of extraction module 130 having driving means such a motor 132 which rotates pulling gears 133 (e.g., by common transmission means known in the art) being engaged through grooves 131*a* of extraction sleeve 131 with corresponding jags of linking arrangement 160 (further illustrated in FIGS. 17A-17C) thus when rotated by motor 132, linking arrangements 160 are pulled through extraction module 130 where cartridges 2 are extracted from housing linking arrangements 160 thereof (i.e., which are disposed away through exhaust aperture 131*b* of sleeve 131 of extraction module 130) to be fed by feeding mechanism 140 (further illustrated in FIG. 18) into magazine 150 through intake aperture 151*a*.

Figure 16C:
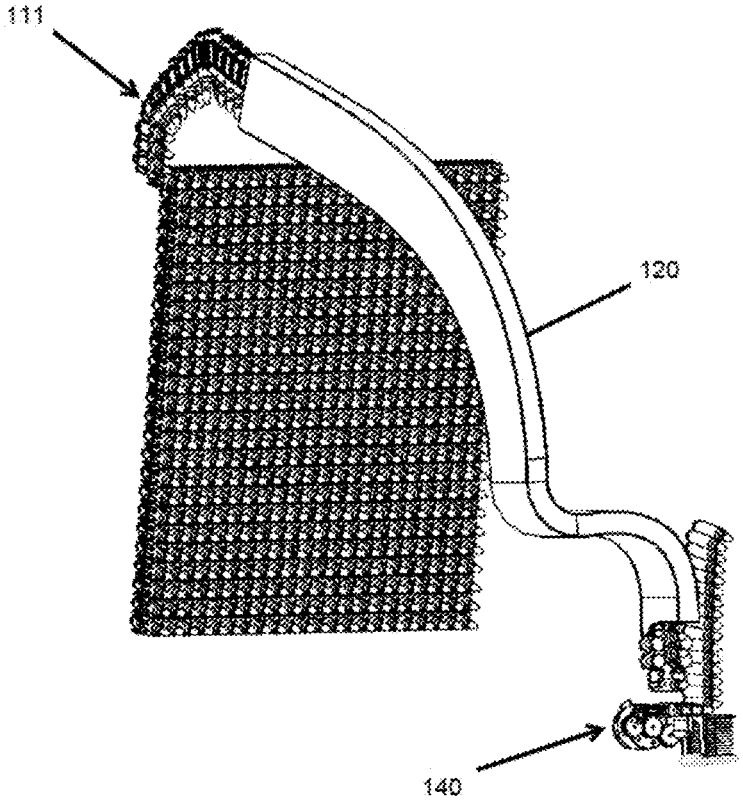
FIG. 16C schematically illustrates an exemplary storage configuration of a chain of parallelly-linked cartridges within a backpack, being routed through a lead duct, according to an embodiment of the invention.

FIG. 16C schematically illustrates an exemplary storage configuration of a chain 111 of parallelly-linked cartridges 2 within backpack 10, being routed through lead duct 120 towards feeding mechanism 140.

FIG. 17A schematically illustrates an exemplary configuration of a linking arrangement suitable for use by a parallel ammunition storage and feeding system, according to an embodiment of the invention, in which each cartridge 2 is housed by a linking arrangement 160 essentially comprising two shell sections 161 & 162 connected by a relatively breakable connections 161*a* & 162*a* (i.e., and corresponding lower connections 161*b* & 162*b* of FIG. 17B) having predetermined connection strength suitable to be disintegrated by extraction module 130 as illustrated by FIG. 17B, where each of sections 161 & 162 comprises pulling jags 163 through which linking arrangement 160 is pulled through extraction module 130 by pulling gears 133, linking grooves 164 and linking element 165 threaded to corresponding linking grooves 164 of two residing linking arrangement 160 thereby forming the linking of linking arrangements 160.

Figure 17C:
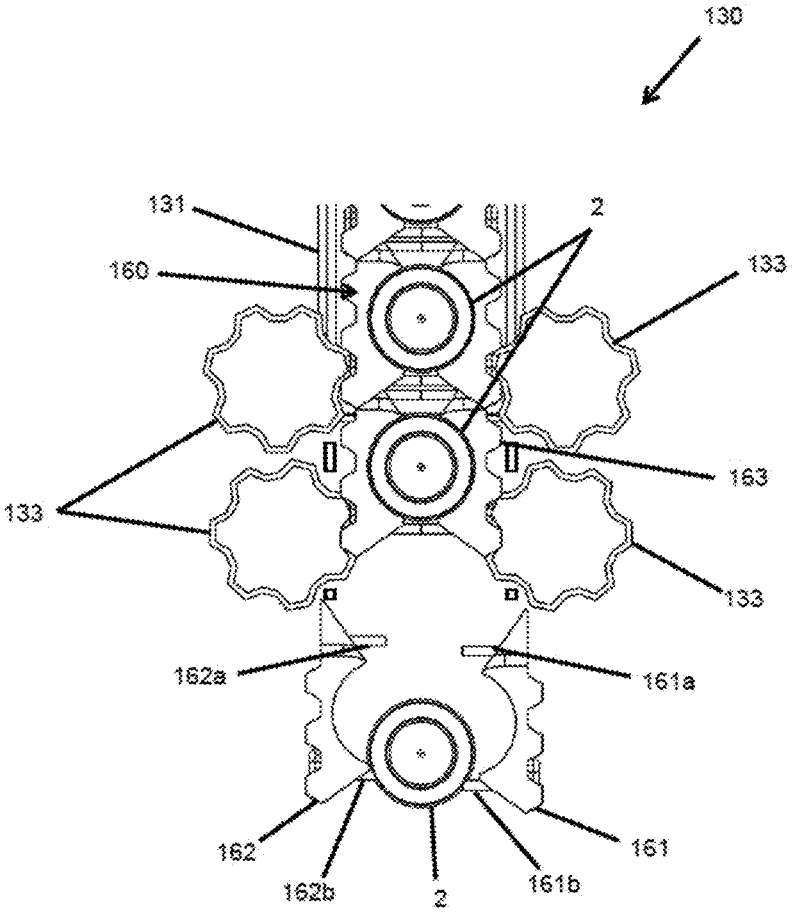
FIG. 17C is a schematic illustration of a section view of an extraction module, showing linking arrangements being pulled by gears, then being disintegrated, thus releasing cartridges towards a feeding arrangement.

FIG. 17B schematically illustrates disintegration of a linking arrangement by extraction module 130, according to an embodiment of the invention, in which the lower edges 131*c* of exhaust aperture 131*b* are inclined correspondingly with lower inclined edges 161*c* & 162*c* of sections 161 & 162, where the lower portion 131*d* of sleeve 131 narrows down so that each linking arrangement 160 approaching downwardly (i.e., forced by gears 133 pulling downlinking arrangements 160) engaging lower edges 131*c* with its lower inclined edges 161*c* & 162*c* being forced to shift outwardly thus breaking the lower connections 161*b* & 162*b* and forcing sections 161 & 162 to separate and to exit sleeve 131 through exhaust aperture 131*b*. FIG. 17C schematically illustrates a section view of extraction module 130, showing linking arrangements 160 being pulled by gears 133, then being disintegrated, thus releasing cartridges 2 towards feeding arrangement 140 illustrated by the following FIG. 18.

Figure 18:
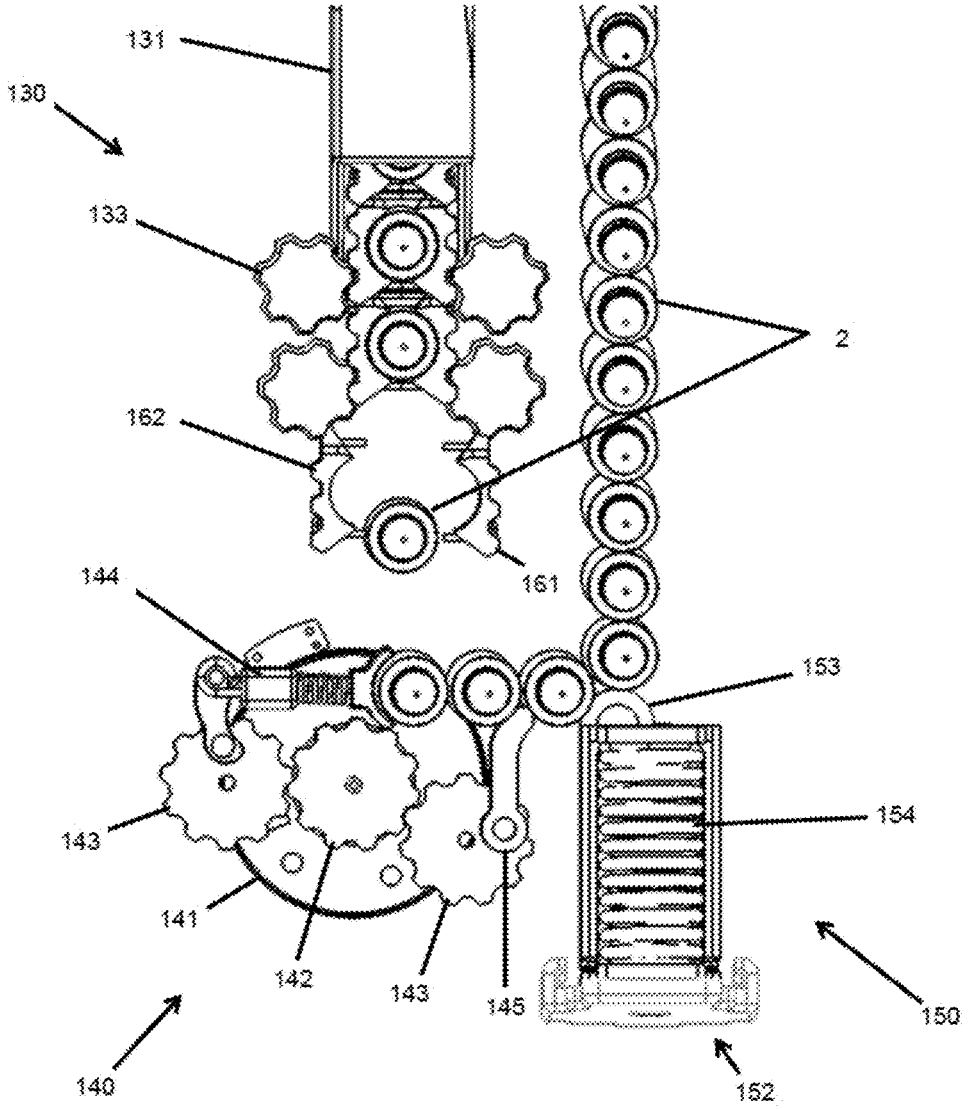
FIG. 18 schematically illustrates an internal view of extraction module, feeding mechanism, and a magazine of ammunition storage and feeding system, according to an embodiment of the invention.

FIG. 18 schematically illustrates an internal view of extraction module 130, feeding mechanism 140, and magazine 150 of a parallel ammunition storage and feeding system, according to an embodiment of the invention, in which cartridges 2 housed in linking arrangements 160 are pulled and extracted by extraction module 130, then moving into feeding mechanism 140, which comprises a powered drive such as motor 141 rotating a driving gear 142 of which rotation forces feeding transmission gears 143 to counter-rotate, wherein the synchronized rotation of gears 143 actuate reciprocating operation of pushing element 144 and feeding element 145, thus feeding cartridges 2 into magazine 150.

FIG. 18 further illustrates magazine 150 base 152 which comprises a spring-loaded stopper 153, for regulating the feeding of magazine 150 per its emptying pace, for example where the compression load of spring 154 is determined by the stacking level of magazine 150 in such a manner that, for example, whereas rifle 30 does not consume cartridges 2 and magazine 150 is full, spring 154 is fully compressed thus feeding mechanism cannot further feed magazine 50, and whereas rifle 30 consumes cartridges 2 from magazine 50, the tension of spring 154 is reduced correspondingly, thus enabling further feeding of cartridges 2 by feeding mechanism 140.

According to some embodiments of the invention, feedback means are utilized to provide operational and fault indications to the user of the proposed system, such as sensors located across the proposed system (e.g., within backpack 110, leading duct 120, extraction module 130, feeding mechanism 140, or within magazine 150) for detecting that chain 111 of interlinked cartridges 2 is about to be consumed (i.e., a predetermined number of cartridges 2 are left). Of course, since the rotation steps of gears 133 of extraction module 130 can be readily detected (e.g., by suitable optical sensors and jags counting module) and/or counted (e.g., where motor 132 is a step motor).

Figure 19:
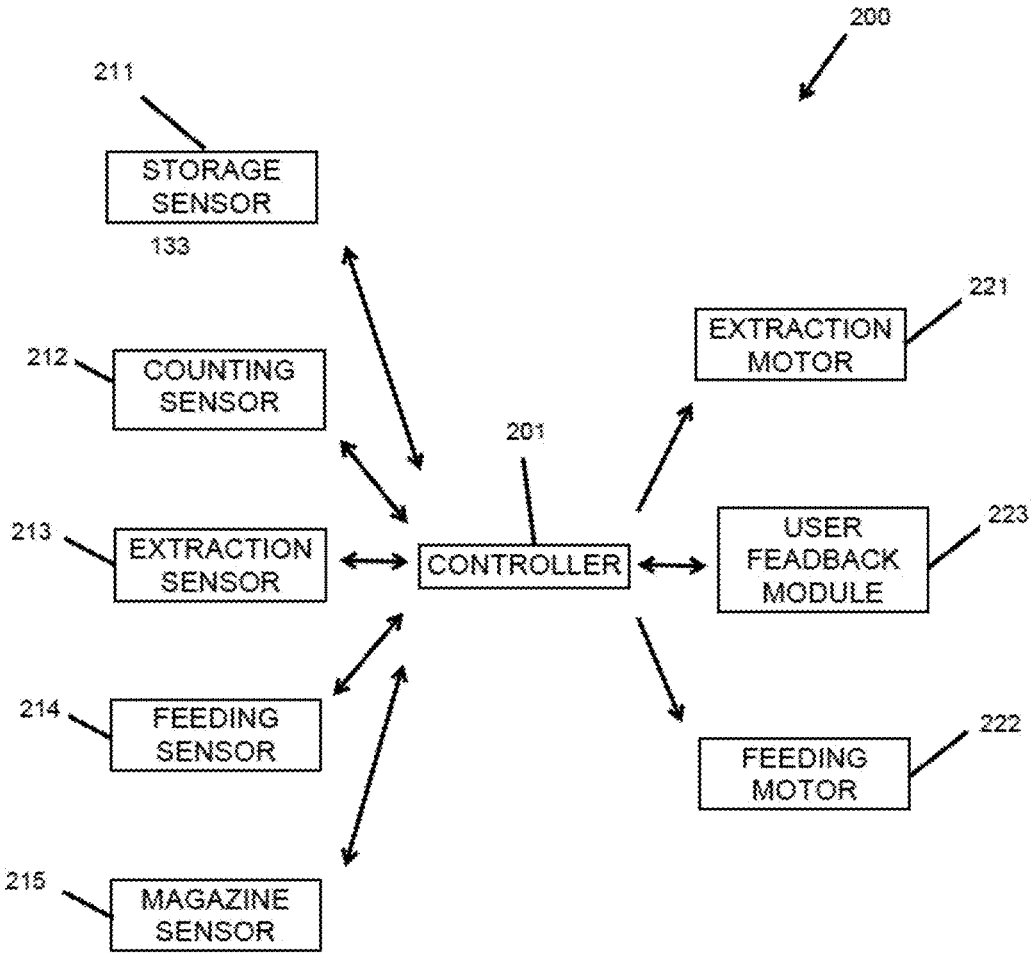
FIG. 19 is a block diagram of an exemplary control configuration of ammunition storage and feeding system, according to an embodiment of the invention.

FIG. 19 is a bloc diagram of an exemplary control configuration of ammunition storage and feeding system, according to an embodiment of the invention, in which a controller 201 (i.e., referring to the term "controller" herein aims to a control unit comprising suitable hardware and operational software thereof) of system 200 is configured to receive indications from one or more sensors deployed across system 200 such as a storage sensor within backpack 110 (bloc 211), a counting sensor indicating proper motion of cartridges 2 through duct 120 or end of chain 111 within duct 120 (bloc 212), a pressure sensor sensing rotation resistance to gears 133 indicating on broken linking arrangement 160 or on the end of chain 111 (bloc 213), similar pressure sensor within feeding mechanism gears 142-143 (bloc 214) which can also indicate on a full magazine 150, and an optical and/or pressure sensors within magazine 150 which can indicate on the stacking level thereof, where controller 201 receives the abovementioned indications and responds according to predetermined scripts, such as to operate extraction motor (bloc 221), feeding motor (bloc 222) and/or initiate audial/visual or mechanical (e.g., vibration) user operational and fault indications.

Although embodiments of the invention have been described by way of illustration, it will be understood that the invention may be carried out with many variations, modifications, and adaptations, without exceeding the scope of the claims. For example, according to some embodiments of the present invention, a single motor is used instead of motors 132 & 141 to rotate gears 133 and 143, thereby reducing the synchronization need between two separate motors.

The invention claimed is:

1. A parallel ammunition storage and feeding system, comprising:

a) a plurality of parallelly-linked cartridges linked by a linking arrangement to form a chain;

b) an extraction module configured to pull said chain and to successively extract said plurality of parallelly-linked cartridges from linking arrangement thereof;

c) a feeding mechanism configured to receive extracted cartridges from said extraction module, and to feed each individual extracted cartridge into a dedicated magazine that is configured to operate in a continuous First-In-First-Out (FIFO) manner, in which the dedicated magazine receives the cartridges via a first opening and outputs the cartridges via a second opening through which the cartridges are loaded to a corresponding barrel of a weapon; and d) a lead duct adapted to connect said chain of parallelly-linked cartridges to said extraction module;

in which each of the linking arrangements comprises shell sections in which the parallelly-linked cartridges are housed, where the extraction module extracts said parallelly-linked cartridges by forcing said shell sections to separate.

2. The system according to claim 1, in which the lead duct is semi-flexible.

3. The system according to claim 1, in which the dedicated magazine comprises a spring-loaded stopper, for regulating the feeding of said dedicated magazine by the feeding mechanism.

4. The system according to claim 1, further comprises feedback means for providing operational and fault indications.

5. The system according to claim 4, in which the feedback means are selected from the group consisting of: optical sensors, pressure sensors, or any combination thereof.

6. The system according to claim 4, in which the Indications are selected from the group consisting of: visual indications, audial indications, mechanical indications, or any combination thereof.

7. The system according to claim 4, further comprises a control means for receiving indications from the feedback means and to respond accordingly.

8. The system according to claim 7, in which the response is selected from the group consisting of: operation of the extraction module, operation of the feeding mechanism, initiation user operational and fault indications, or any combination thereof.

9. The system according to claim 1, in which each of the extraction module and the feeding mechanism comprises a rotation motor.

10. The system according to claim 1, in which the extraction module and the feeding mechanism are driven by a single motor.

* * * * *